US008769757B2

(12) United States Patent
Payne et al.

(10) Patent No.: US 8,769,757 B2
(45) Date of Patent: Jul. 8, 2014

(54) CLEANING SYSTEM

(71) Applicant: Dakota Supplies, Inc., Calgary (CA)

(72) Inventors: Ronald Lindsay Vaughan Payne, Calgary (CA); Deborah Marie Humphries, Calgary (CA); David Patrick Lampson, Grass Valley (CA)

(73) Assignee: Dakota Supplies, Inc., Calgary, Alberta (CA)

( * ) Notice: Subject to any disclaimer, the term of this patent is extended or adjusted under 35 U.S.C. 154(b) by 0 days.

(21) Appl. No.: 13/950,002

(22) Filed: Jul. 24, 2013

(65) Prior Publication Data

US 2013/0305470 A1 Nov. 21, 2013

Related U.S. Application Data

(60) Provisional application No. 61/675,398, filed on Jul. 25, 2012.

(51) Int. Cl.

| | |
|---|---|
| ***A47L 13/22*** | (2006.01) |
| ***A47L 13/51*** | (2006.01) |
| ***A47L 13/46*** | (2006.01) |
| ***A47L 13/17*** | (2006.01) |
| ***A47L 13/26*** | (2006.01) |
| ***A47L 13/24*** | (2006.01) |

(52) U.S. Cl.

CPC ..... *A47L 13/26* (2013.01); *A47L 13/22* (2013.01); *A47L 13/51* (2013.01); *A47L 13/46* (2013.01); *A47L 13/17* (2013.01); *A47L 13/24* (2013.01)

USPC ..... 15/104.94; 15/244.1

(58) Field of Classification Search

USPC ..... 15/104.94, 210.1, 244.1, 257.01, 244.4, 15/228

See application file for complete search history.

(56) References Cited

U.S. PATENT DOCUMENTS

| | | | | |
|---|---|---|---|---|
| 2,841,809 | A * | 7/1958 | Oliver | 132/74.5 |
| 4,884,913 | A * | 12/1989 | Smith et al. | 401/196 |
| 4,886,388 | A | 12/1989 | Gulker | |
| 5,107,562 | A * | 4/1992 | Dunn | 15/167.1 |
| 5,536,095 | A | 7/1996 | Diamond | |
| 6,014,785 | A * | 1/2000 | Punch et al. | 7/105 |
| 6,393,646 | B1 * | 5/2002 | Beers et al. | 15/144.4 |
| 6,623,201 | B2 | 9/2003 | Brumlik | |
| 6,655,866 | B1 | 12/2003 | Morad | |
| 2010/0065082 | A1 * | 3/2010 | Dinh | 134/6 |

* cited by examiner

*Primary Examiner* — Robert Scruggs
(74) *Attorney, Agent, or Firm* — Neustel Law Offices

(57) ABSTRACT

A cleaning system for retaining a cleaning member such as a sponge or mop-head in a compressed and compacted state prior to use. The cleaning system generally includes one or more cleaning cartridges, each of which include a base, a cleaning member secured to the base, and an outer covering compressing the cleaning member. Upon removal of the outer covering, the cleaning member will expand and be ready for use. Also disclosed is a dispensing unit adapted to store, activate, use and dispose of the cleaning cartridges. The dispensing unit includes a nozzle which retains the outermost cleaning cartridge in a position partially extending through an outlet opening awaiting use. The dispensing unit may include a telescoping handle so that it may be converted for use as a mop.

9 Claims, 19 Drawing Sheets

CLEANING SYSTEM

CROSS REFERENCE TO RELATED APPLICATIONS

I hereby claim benefit under Title 35, United States Code, Section 119(e) of U.S. provisional patent application Ser. No. 61/675,398 filed Jul. 25, 2012. The 61/675,398 application is currently pending. The 61/675,398 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a cleaning mechanism and more specifically it relates to a cleaning system for retaining a cleaning member such as a sponge or mop-head in a compressed and compacted state prior to use.

2. Description of the Related Art

Any discussion of the related art throughout the specification should in no way be considered as an admission that such related art is widely known or forms part of common general knowledge in the field.

Disposable cleaning devices such as sponges, mop-heads and the like have enjoyed increased popularity in recent years. Such disposables as the SWIFFER SWEEPER produced by Proctor and Gamble are generally comprised of a disposable cleaning member which is removably secured to the end of a specialized mop structure. Generally, the cleaning members (commonly cleaning pads soaked in a cleaning solution) are stored together in a closed container.

In such prior art systems, the cleaning pads must be manually pulled from the container and attached to the end of the mop. Thus, an individual is forced to get his/her hands wet with the cleaning solution, which can lead to allergic reactions or stains on clothing. Additionally, it is often a difficult task to secure the cleaning member to the end of the mop. Finally, the large size of the cleaning members can take up valuable space when travelling or transferring the mop and cleaning members from one location to another.

Because of the inherent problems with the related art, there is a need for a new and improved cleaning system for retaining a cleaning member such as a sponge or mop-head in a compressed and compacted state prior to use.

BRIEF SUMMARY OF THE INVENTION

The invention generally relates to a cleaning system which includes one or more cleaning cartridges, each of which include a base, a cleaning member secured to the base, and an outer covering compressing the cleaning member. Upon removal of the outer covering, the cleaning member will expand and be ready for use. Also disclosed is a dispensing unit adapted to store, activate, use and dispose of the cleaning cartridges. The dispensing unit includes a nozzle which retains the outermost cleaning cartridge in a position partially extending through an outlet opening awaiting use. The dispensing unit may include a telescoping handle so that it may be converted for use as a mop.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
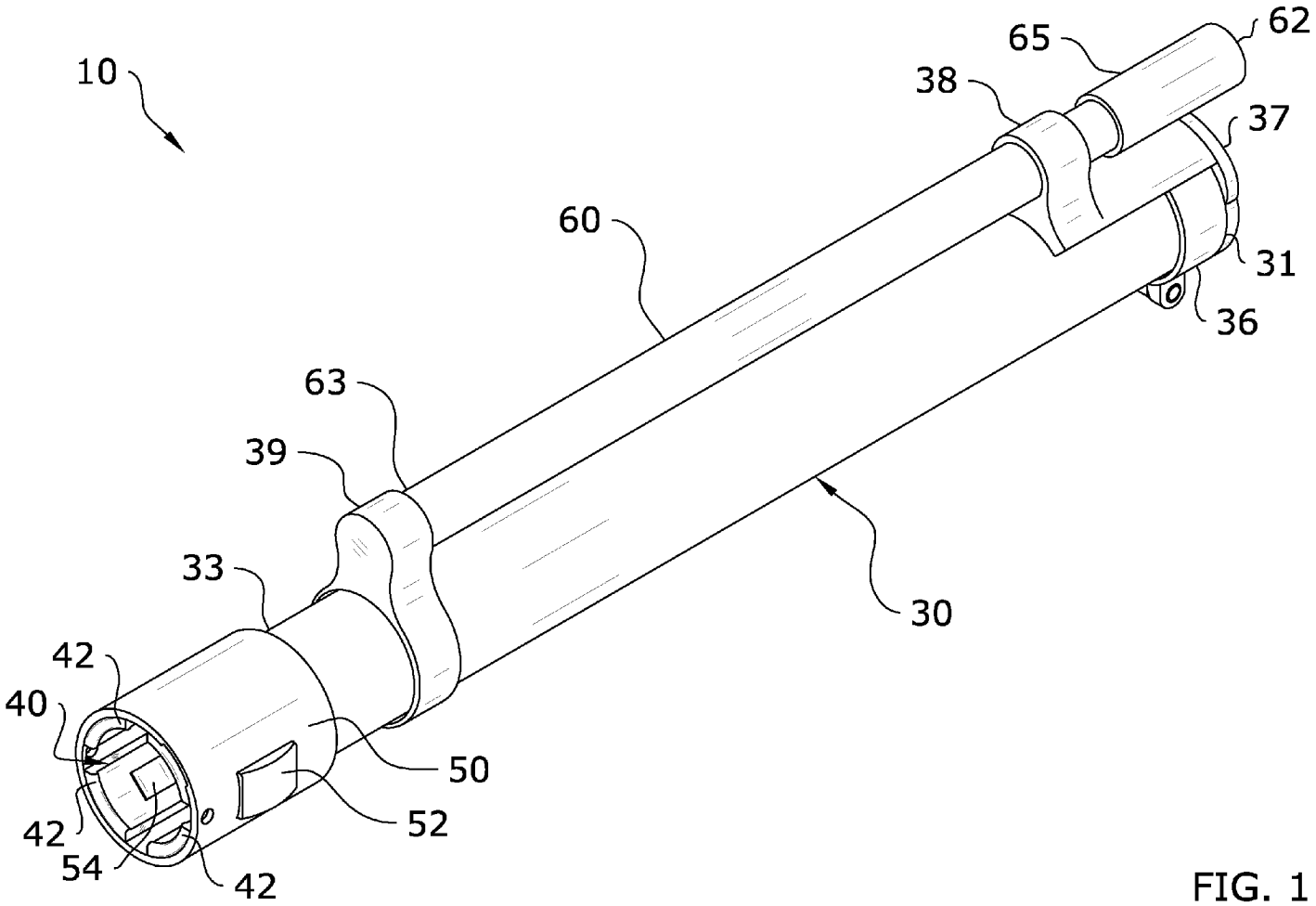
FIG. 1 is an upper perspective view of the dispenser unit of the present invention.

Turning now descriptively to the drawings, in which similar reference characters denote similar elements throughout the several views, FIGS. 1 through 19 illustrate a cleaning system 10, which comprises one or more cleaning cartridges 20, each of which include a base 22, a cleaning member 26 secured to the base 22, and an outer covering 28 compressing the cleaning member 26. Upon removal of the outer covering 28, the cleaning member 26 will expand and be ready for use. Also disclosed is a dispensing unit 30 adapted to store, activate, use and dispose of the cleaning cartridges 20. The dispensing unit 30 includes a nozzle 40 which retains the outermost cleaning cartridge 20 in a position partially extending through an outlet opening 34 awaiting use. The dispensing unit 30 may include a telescoping handle 60 so that it may be converted for use as a mop.

B. Cleaning Cartridge

As best shown in FIGS. 3 and 16-18, the present invention utilizes a unique cleaning cartridge 20 which stores a cleaning member 26 in a compacted state until activation occurs, at which time the cleaning member 26 is expanded into a state suitable for being used to clean various surfaces. The structure and configuration of the cleaning cartridges 20 may vary and thus should not be construed as being limited by the exemplary figures hereto.

Figure 16:
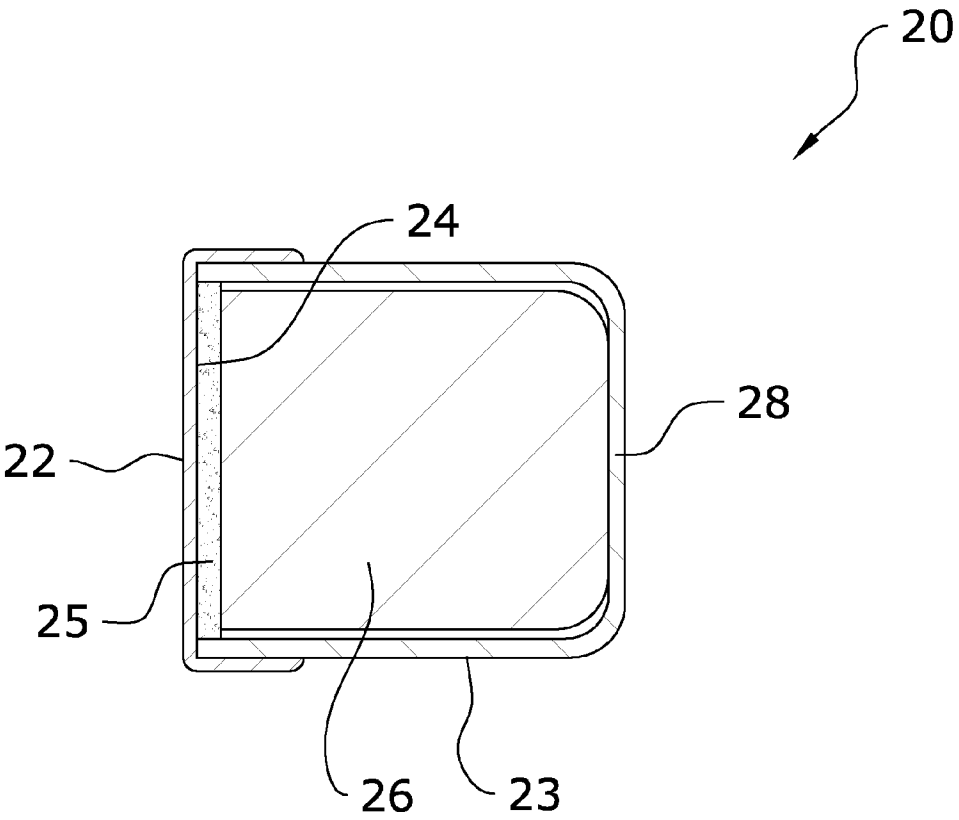
FIG. 16 is a side sectional view of a cleaning cartridge of the present invention.

As shown in FIG. 16, the cleaning cartridge 20 generally comprises a base 22, a cleaning member 26 secured to the base 22, and an outer covering 28 removably secured to the base 22 around the cleaning member 26. The base 22 may be comprised of various structures, but will preferably be comprised of a rigid, round cap-like structure to which the cleaning member 26 is fixedly secured.

Figure 13:
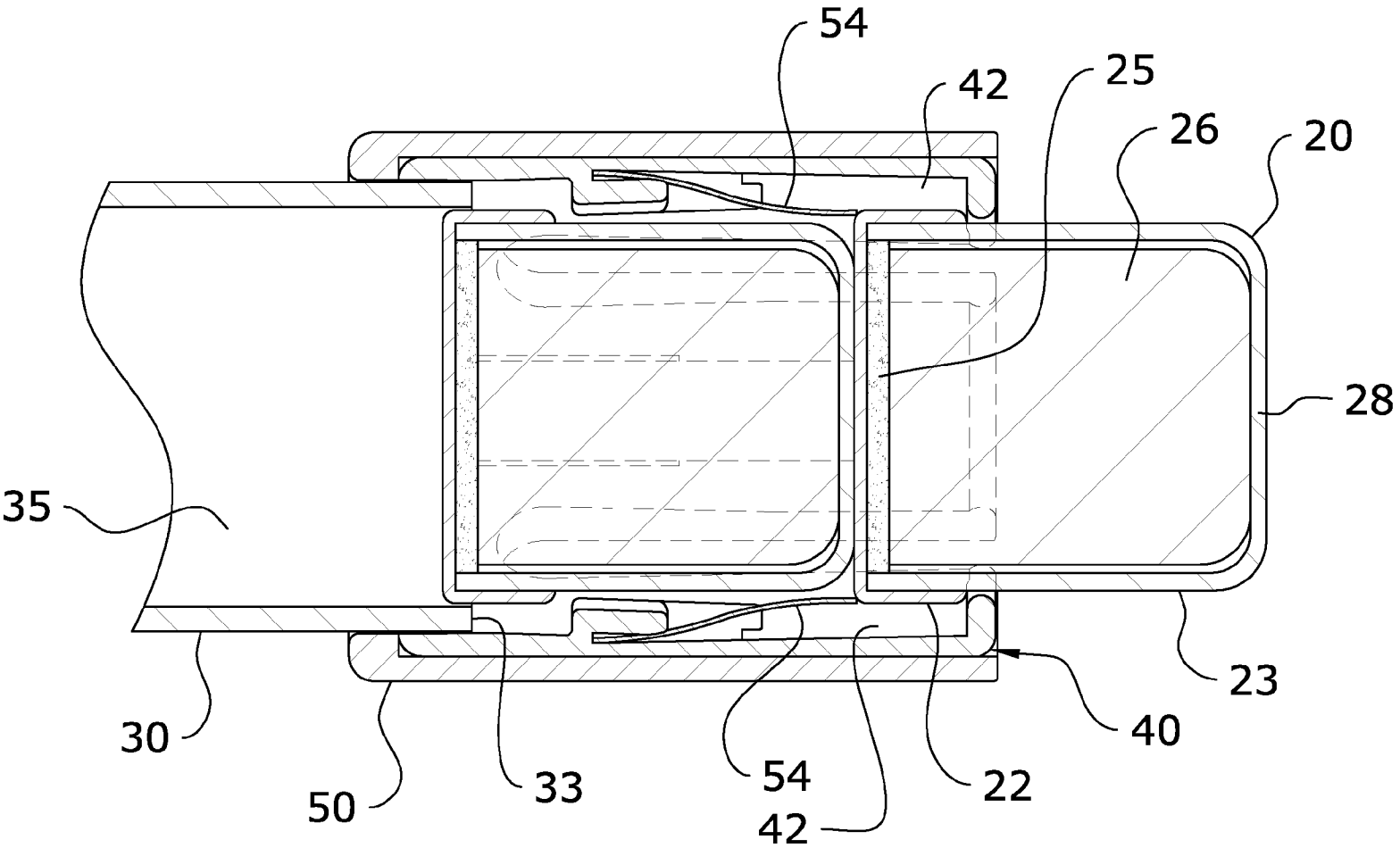
FIG. 13 is a first side sectional view of the nozzle and cleaning cartridges of the present invention.
Figure 15:
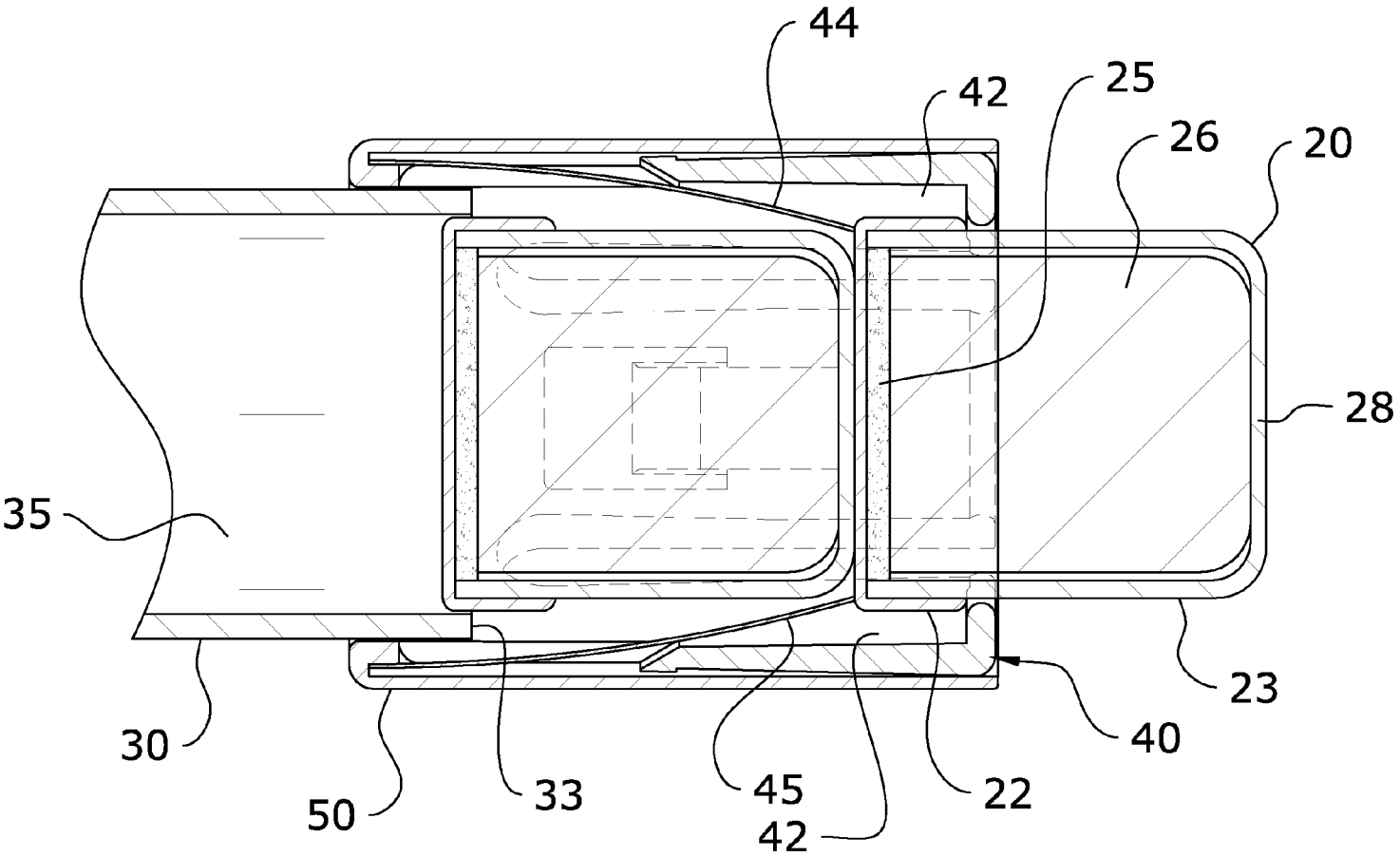
FIG. 15 is a second side sectional view of the nozzle and cleaning cartridges of the present invention.
Figure 17:
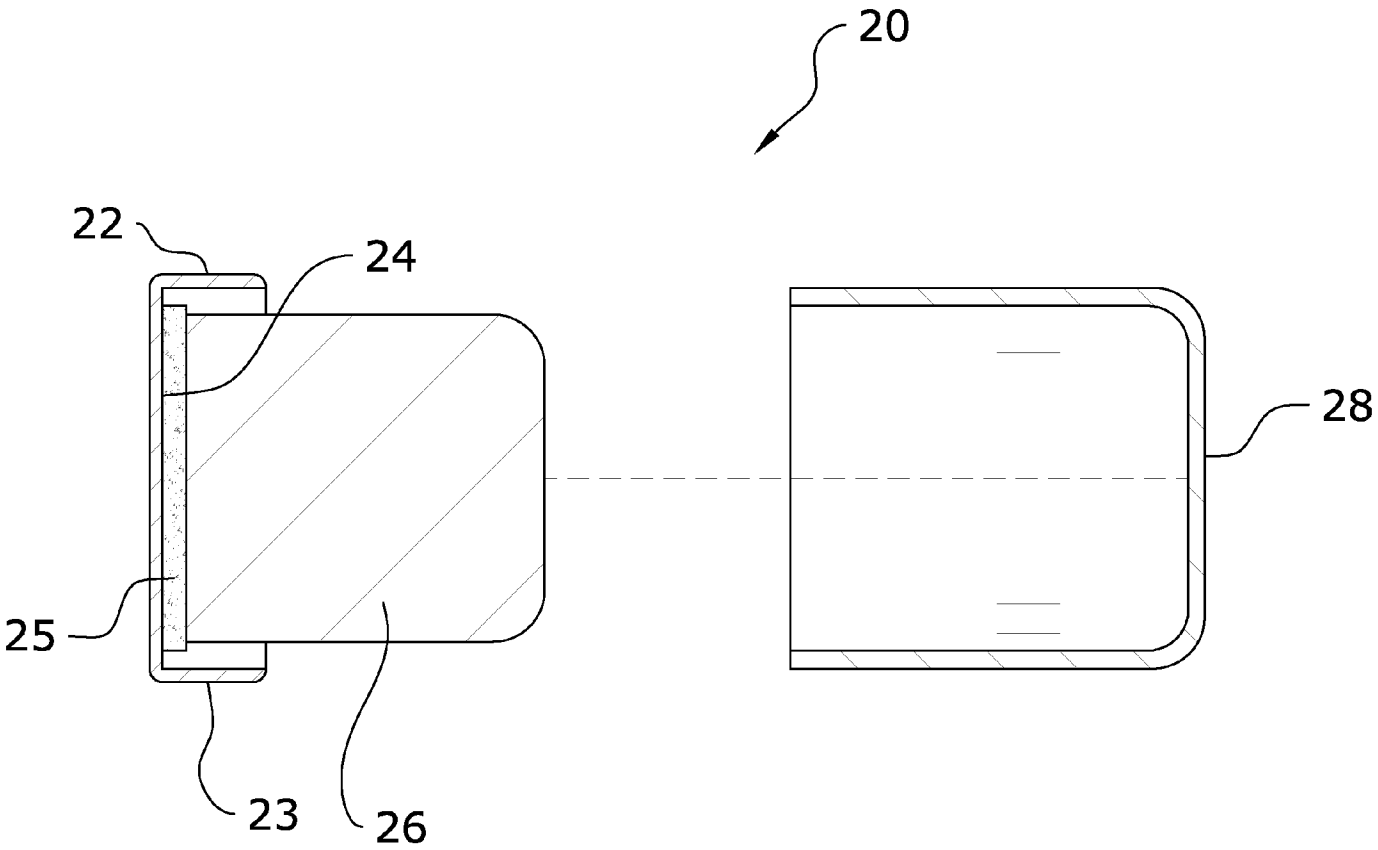
FIG. 17 is a side sectional view illustrating removal of the base from the cleaning cartridge prior to expansion of the cleaning member.
Figure 18:
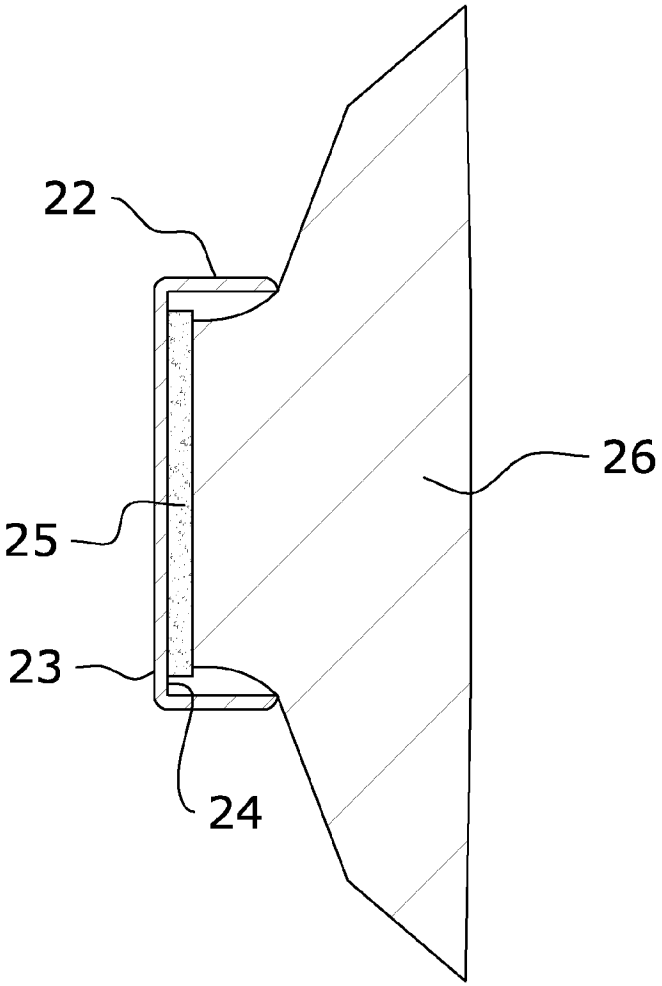
FIG. 18 is a side sectional view of a cleaning cartridge with the base removed and the cleaning member expanded.

The base 22 generally includes an outer surface 23 and an inner surface 24. The outer surface 23 of the base 22 is adapted to be engaged by the nozzle 40 of the dispensing unit 30 of the present invention as best shown in FIGS. 13 and 15. The cleaning member 26 of the present invention will be fixedly secured to the inner surface 24 of the base 22 as shown throughout the figures. Various methods and devices may be utilized to secure the cleaning member 26 to the base 22, such as an adhesive 25 as best shown in FIGS. 16-18. In alternate embodiments, the cleaning member 26 may be secured to the inner surface 24 of the base 22 via such methods as pressure fitting, frictional resistance, ultrasonic welding, or various other methods known in the art to fixedly secure one object to another. The cleaning member 26 will preferably be fixedly secured to the inner surface 24 of the base 22 in such a manner as not to become partially or fully dislodged as the cleaning member 26 is being drawn across various surfaces for cleaning.

The cleaning member 26 is secured to the inner surface 24 of the base 22 such as by adhesive 25 as shown throughout the figures. The outer covering 28, which encloses the cleaning member 26 within itself, is generally removably secured to the base 22. When the outer covering 28 is intact, the cleaning member 26 will be in a compressed state as shown in FIG. 16. When the outer covering 28 is removed or broken as shown in FIG. 17, the cleaning member 26 will expand to be used as shown in FIG. 18.

The outer covering 28 may be comprised of a rigid container or, in some embodiments, may be comprised of a flexible or semi-rigid structure surrounding the compressed cleaning member 26. For example, the outer covering 28 may be comprised of a plastic wrap which acts to seal and compress the cleaning member 26. Preferably, the outer covering 28 will fully seal the cleaning member 26 therein to prevent leakage of any cleaning solution included therewith.

Figure 19:
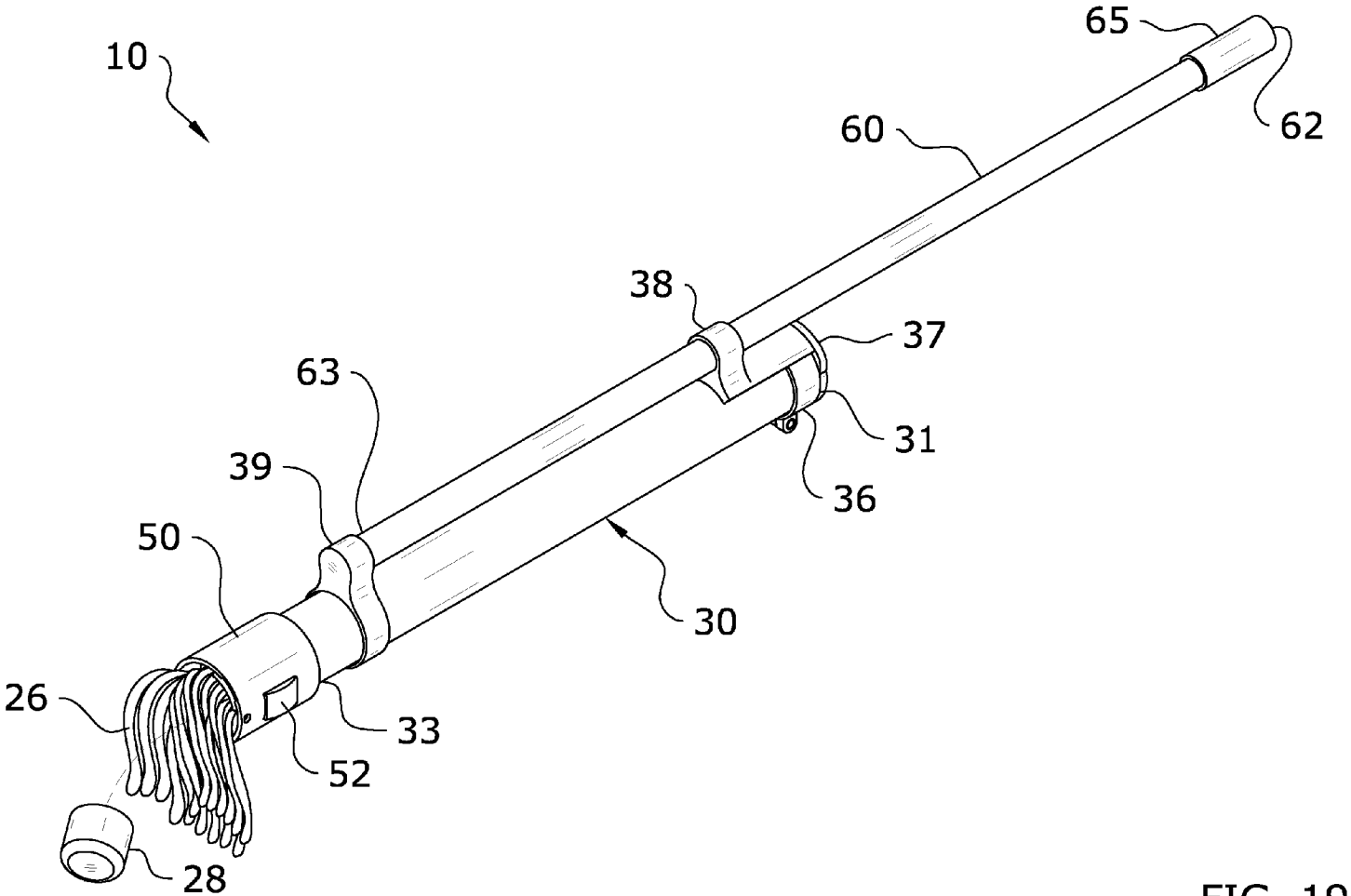
FIG. 19 is an upper perspective view of the present invention with an alternate embodiment of the cleaning member fully expanded.

A wide range of cleaning members 26 may be utilized with the present invention, so long as they may be compressed within the outer covering 28 prior to use and expanded upon removal or breaking of the outer covering 28. By way of example and without limitation, the cleaning member 26 could be comprised of an expandable sponge as shown in FIG. 18 or may be comprised of a micro fiber finger structure as best shown in FIG. 19.

Any number of cleaning members 26 may be used with the present invention so long as they may be compacted within the cleaning cartridge 20 and expanded upon removal and/or breaking of the outer covering 28. In some embodiments, the cleaning member 26 may be retained in a dried state. In other embodiments, the cleaning member 26 may be stored within the cleaning cartridge 20 with a cleaning solution to aid in cleaning various surfaces upon opening of the cartridge 20.

C. Dispensing Unit

Figure 2:
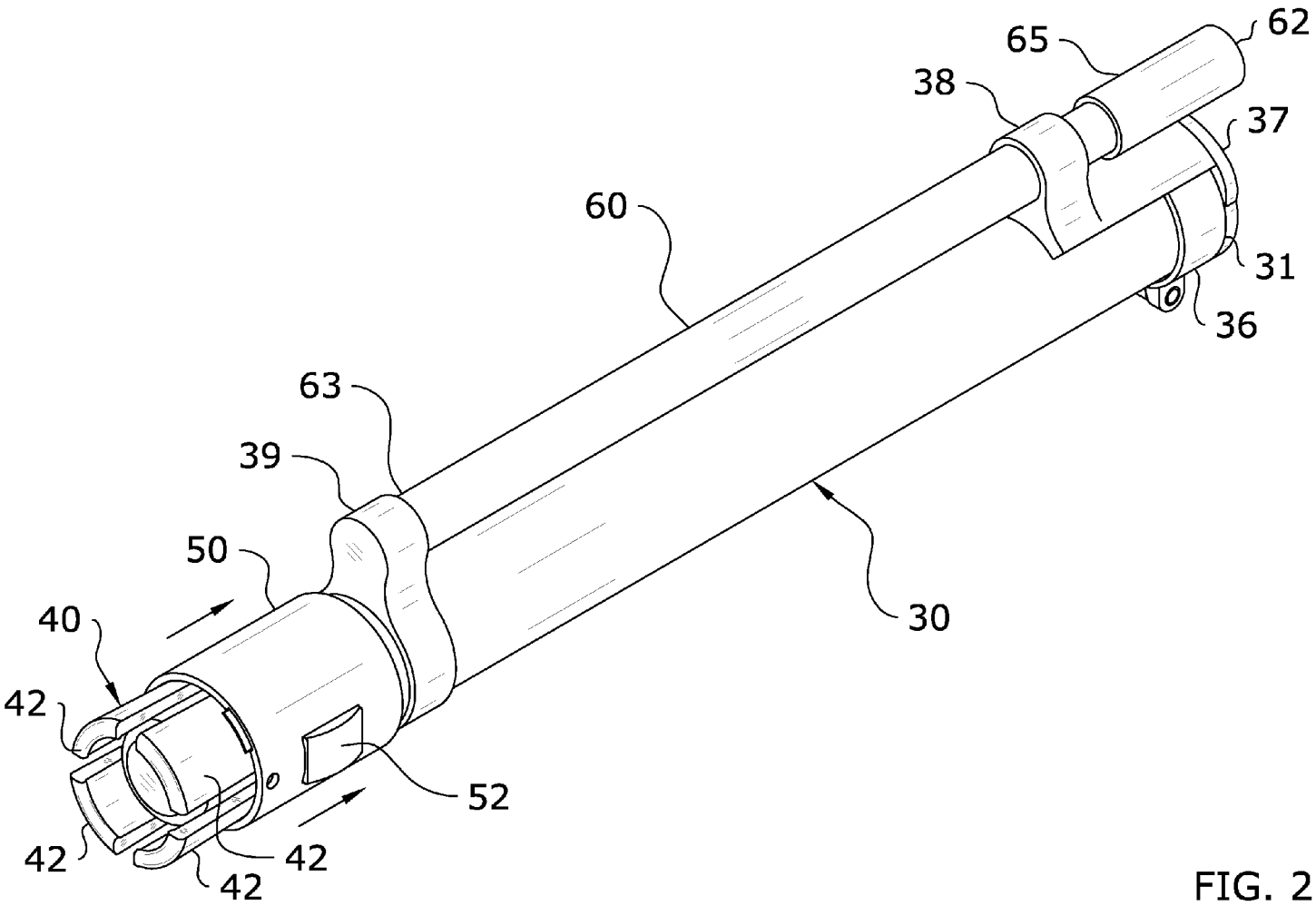
FIG. 2 is an upper perspective view of the dispenser unit with the outer sleeve pulled back to expose the nozzle.
Figure 3:
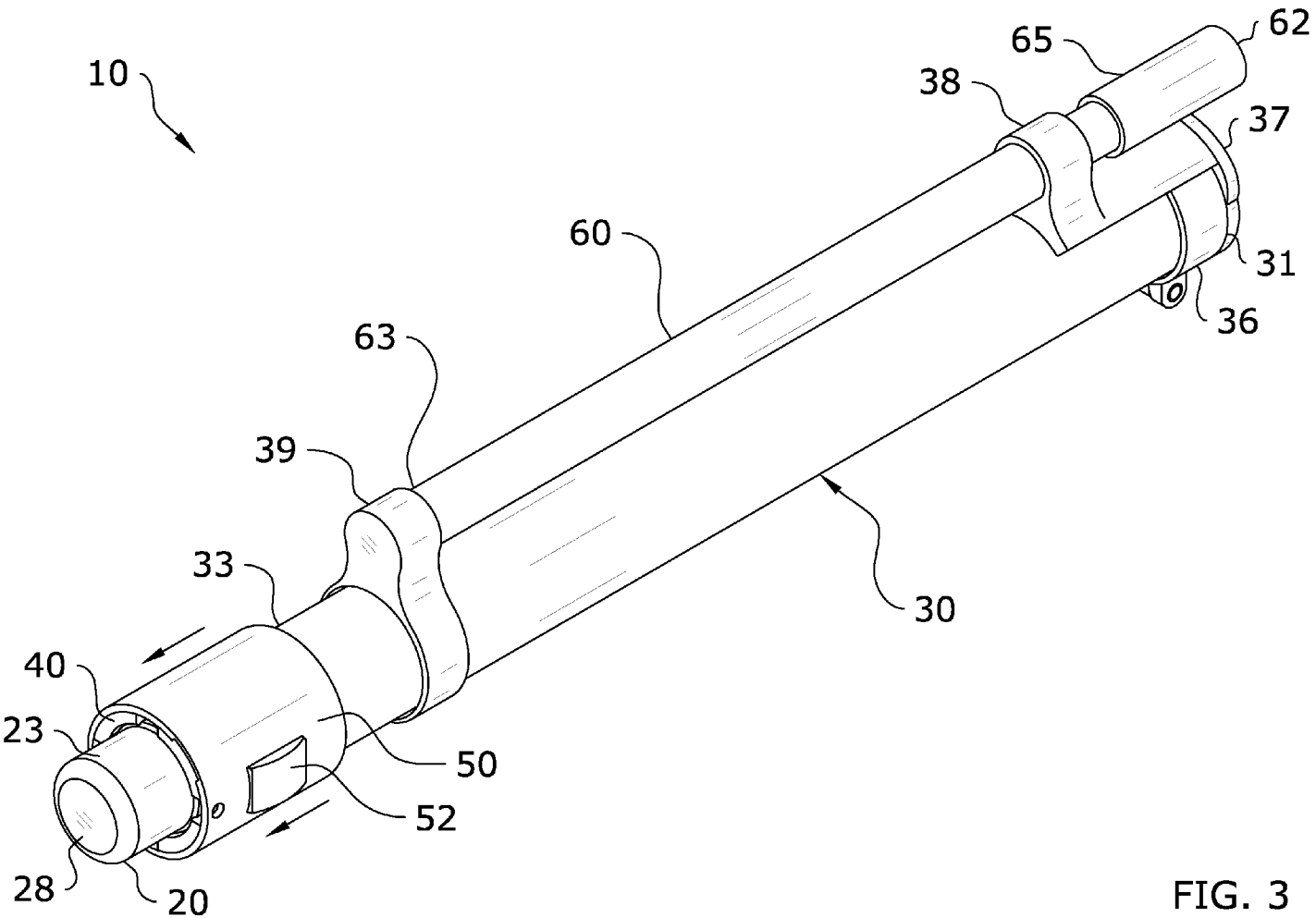
FIG. 3 is an upper perspective view of the dispenser unit with a cleaning cartridge positioned therein.

The cleaning system 10 may include a dispensing unit 30 which stores, activates, and dispenses the cleaning cartridges 20 of the present invention. As best shown in FIGS. 1-3, the dispensing unit 30 comprises a substantially tubular member having a first end 31 and a second end 33. A channel 35 runs through the dispensing unit 30 between its first and second ends 31, 33. The dispensing unit 30 may include a first bracket 38 and a second bracket 39 for securing a telescopic handle 60 to the dispensing unit 30 as shown in the figures and discussed herein. In some embodiments, the dispensing unit 30 may include an attached light and/or bottle.

The first end 31 of the dispensing unit 30 includes an inlet opening 32 through which cleaning cartridges 20 may be inserted into the channel 35. The second end 33 of the dispensing unit 30 includes an outlet opening 34 through which the cleaning cartridges 20 are activated for use and dispensed after use. The outermost of the cleaning cartridges 20 will partially extend out of the outlet opening 34 of the dispensing unit 30 prior to activation.

A hinged connector 36 is secured adjacent the first end 31 of the dispensing unit 30 and includes a hinged cap 37 which selectively opens and closes the inlet opening 32 so that cleaning cartridges 20 may be inserted into the channel 35 therethrough. A nozzle 40 and outer sleeve 50 are positioned at the outlet opening 34 for activating and dispensing the outermost cleaning cartridge 20 as discussed below.

i. Nozzle.

The outermost cleaning cartridge 20 will be secured by a nozzle 40 so as to partially extend through the outlet opening 34 as best shown in FIG. 3. The nozzle 40 is positioned adjacent the second end 33 of the dispensing unit 30 so as to surround the outlet opening 34 thereof.

The nozzle 40 acts to retain the cleaning cartridge 20 within the outlet opening 34 prior to use. The nozzle 40 also acts as an anchor on the cleaning cartridge 20 such that the outer covering 28 thereof may be broken or removed to expand the cleaning member 26. The nozzle 40 also is adapted to expand to release the spend cleaning cartridge 20 after use, such that the next cleaning cartridge 20 back in the channel 35 is then moved forward and partially retained within the nozzle 40 for further use.

The nozzle 40 may be comprised of various structures capable of removably securing one of the cleaning cartridges 20 therein. In a preferred embodiment as shown in the figures, the nozzle 40 includes a plurality of adjustable fingers 42 which are adapted to engage with the base 22 of the outermost cleaning cartridge 20 to retain it within the outlet opening 34.

The fingers 42 are adapted to adjust outward to release the cleaning cartridge 20 upon activation of the outer sleeve 50 as discussed below.

Figure 6:
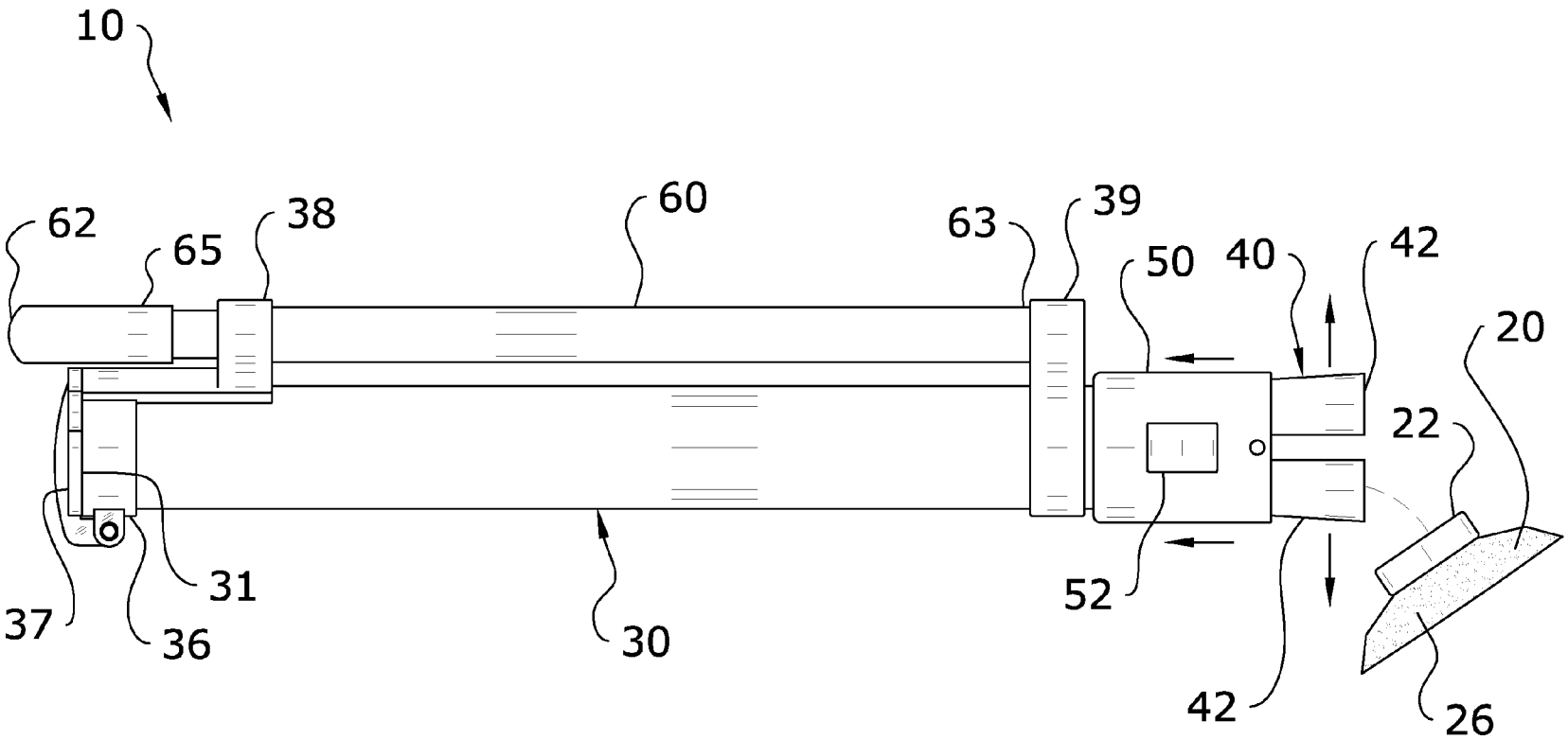
FIG. 6 is a side view of a cleaning cartridge being expelled from the dispenser unit of the present invention.
Figure 7:
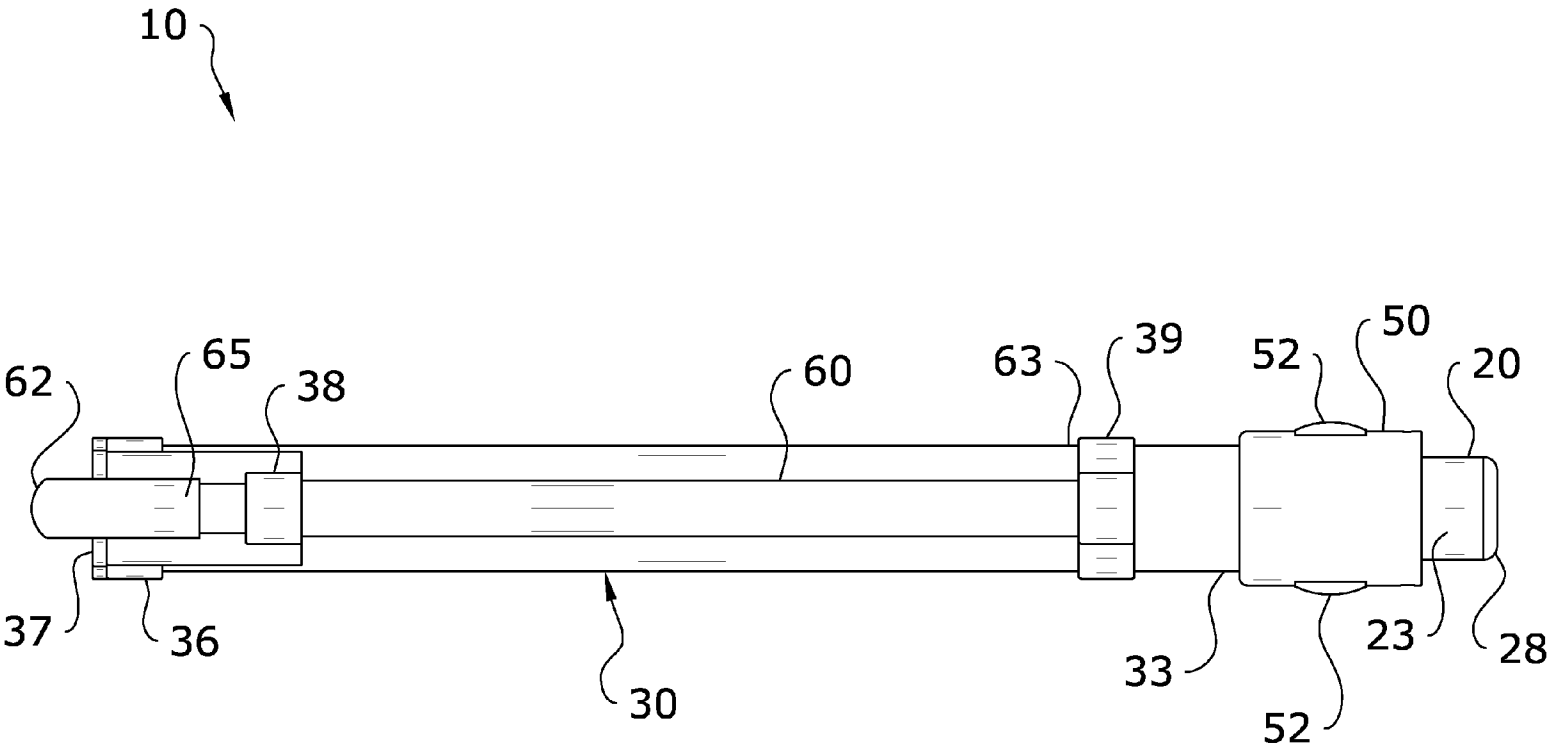
FIG. 7 is a top view of the dispenser unit of the present invention with a cleaning cartridge positioned therein.
Figure 8:
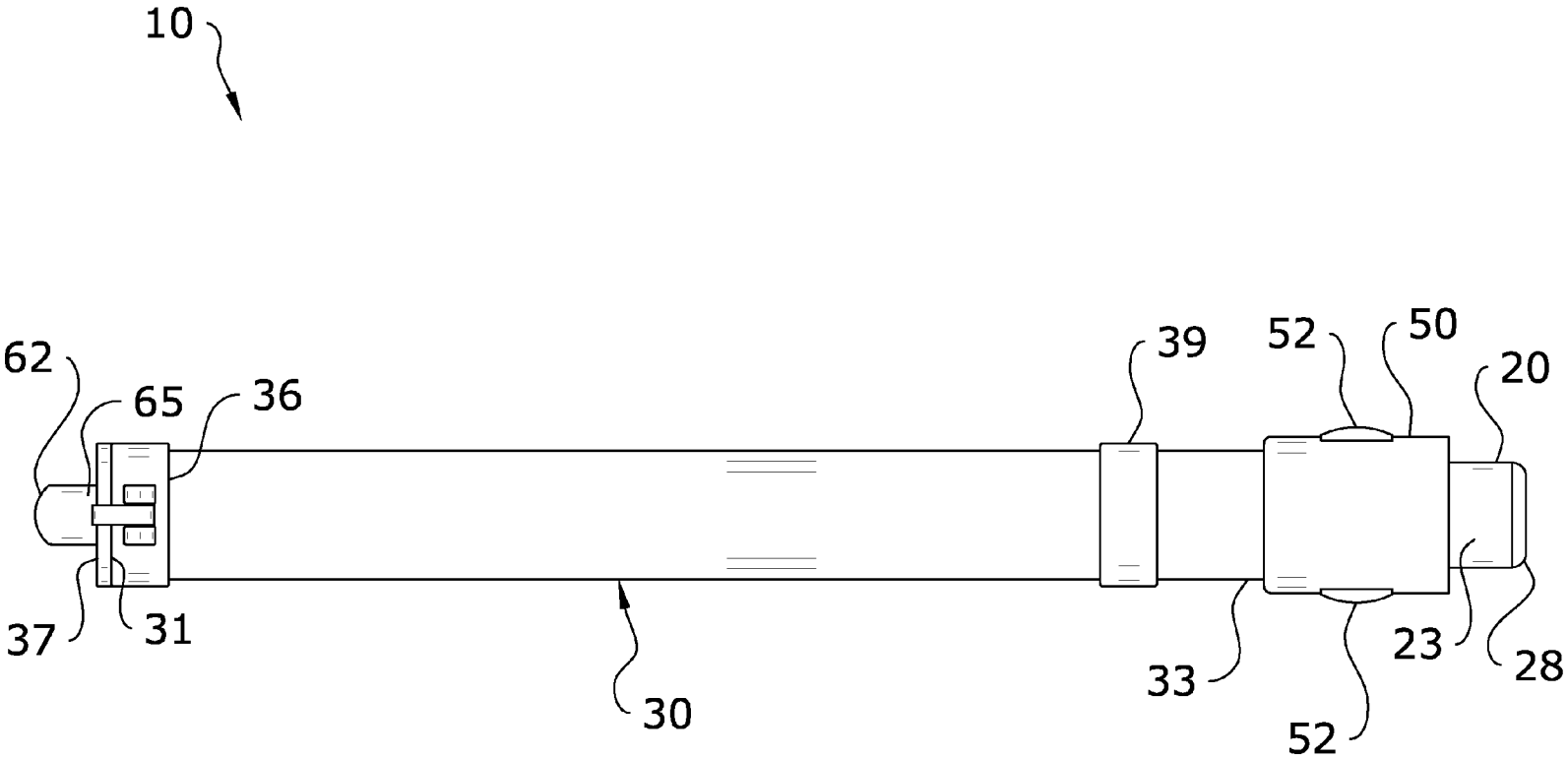
FIG. 8 is a bottom view of the dispenser unit of the present invention with a cleaning cartridge positioned therein.
Figure 9:
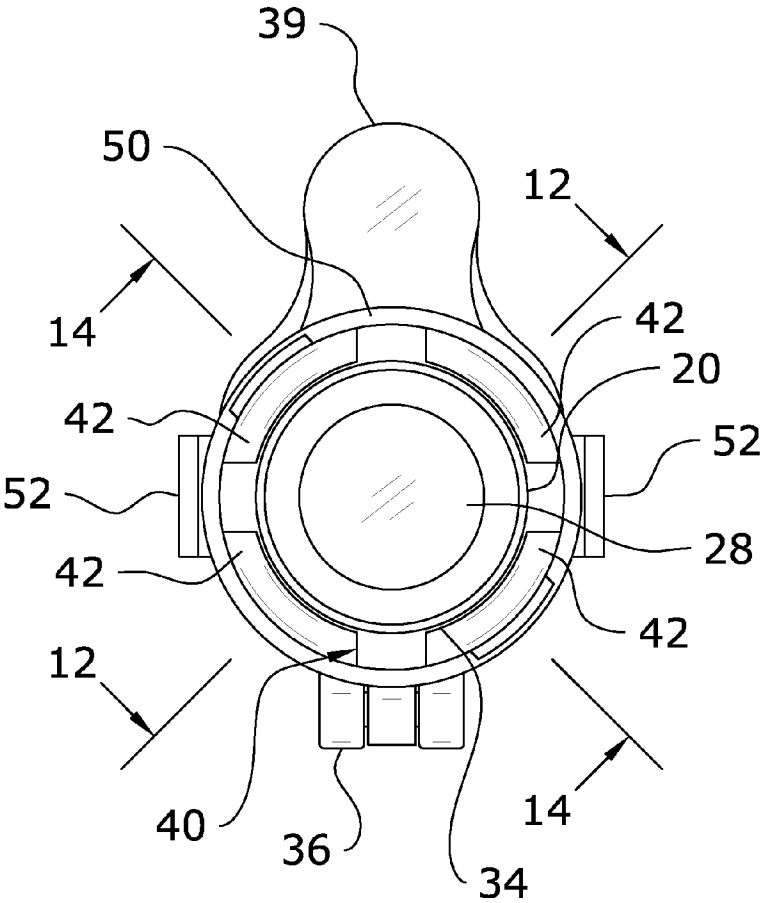
FIG. 9 is a frontal view of the dispenser unit of the present invention with a cleaning cartridge positioned therein.
Figure 10:
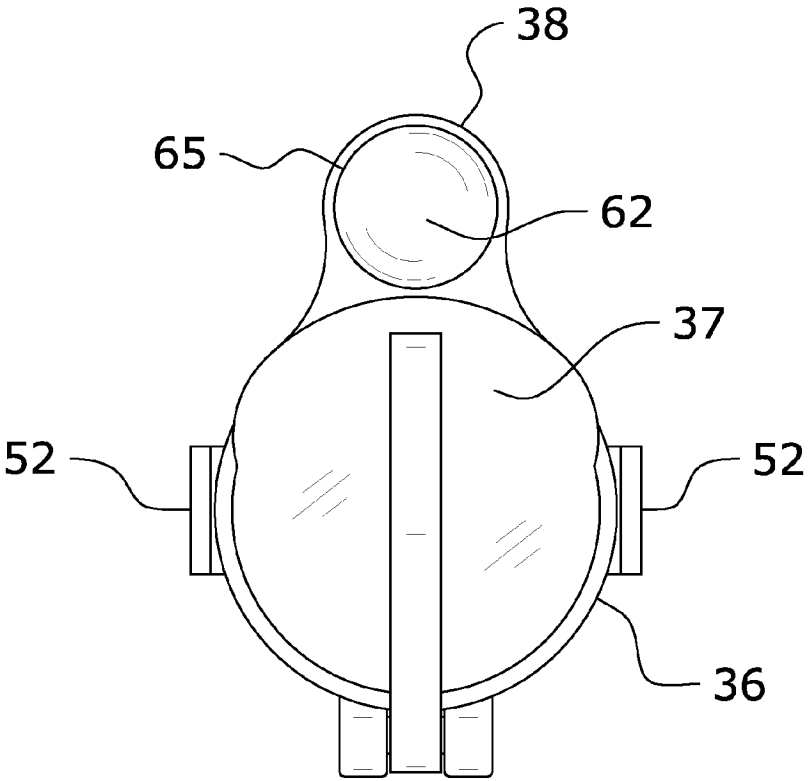
FIG. 10 is a rear view of the dispenser unit of the present invention.
Figure 11:
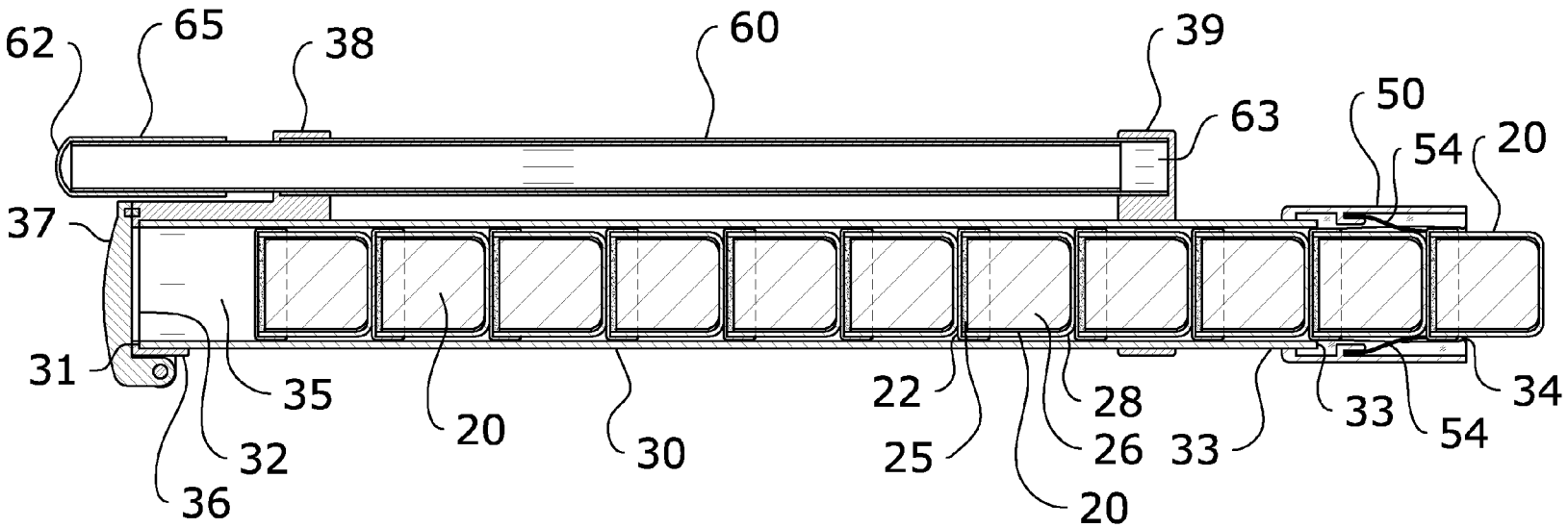
FIG. 11 is a side sectional view of the dispenser unit and cleaning cartridges of the present invention.
Figure 14:
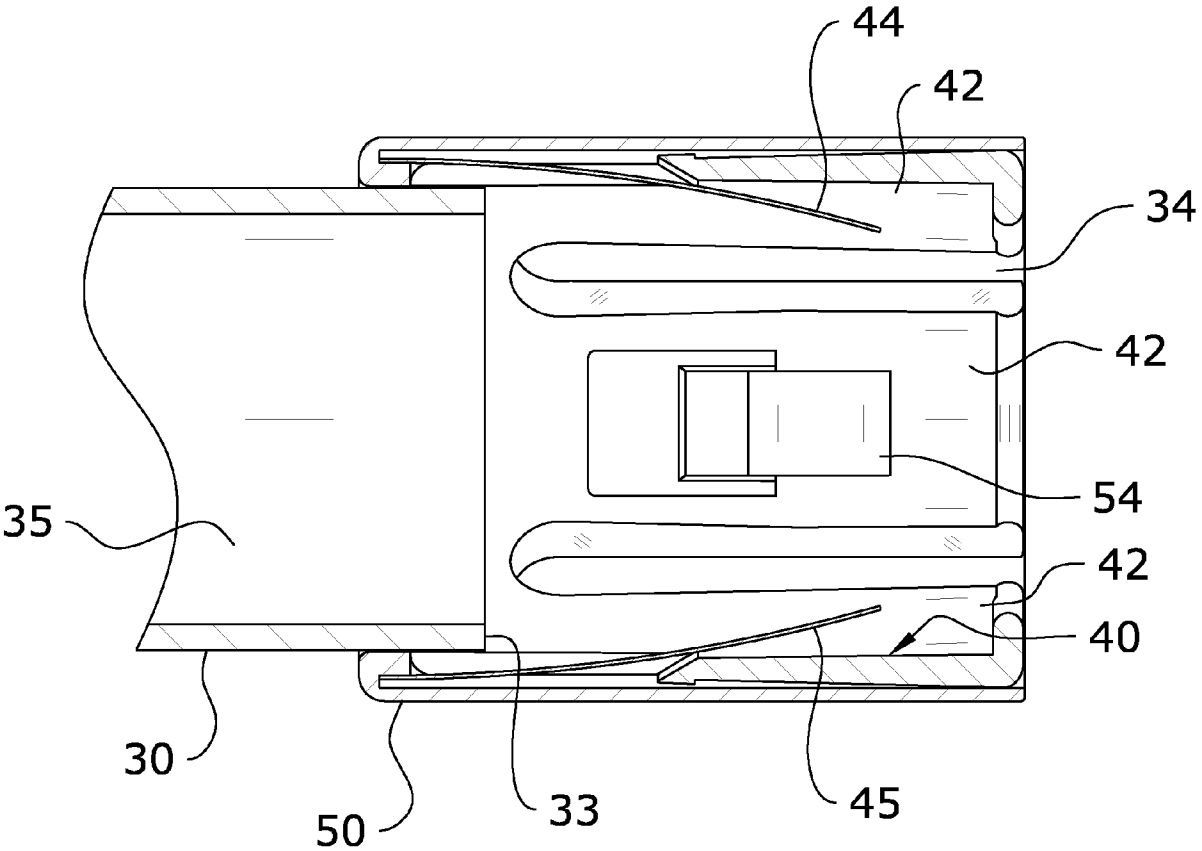
FIG. 14 is a sectional view taken along line 14-14 of FIG. 9

As best shown in FIG. 14, one or more of the fingers 42 of the nozzle 40 may include an inwardly-facing retaining member 44, 45 for preventing the un-used cleaning cartridges 20 within the channel 35 when the fingers 42 are adjusted outwards to release the spend, outermost cleaning cartridge 20 as shown in FIG. 6.

Figure 12:
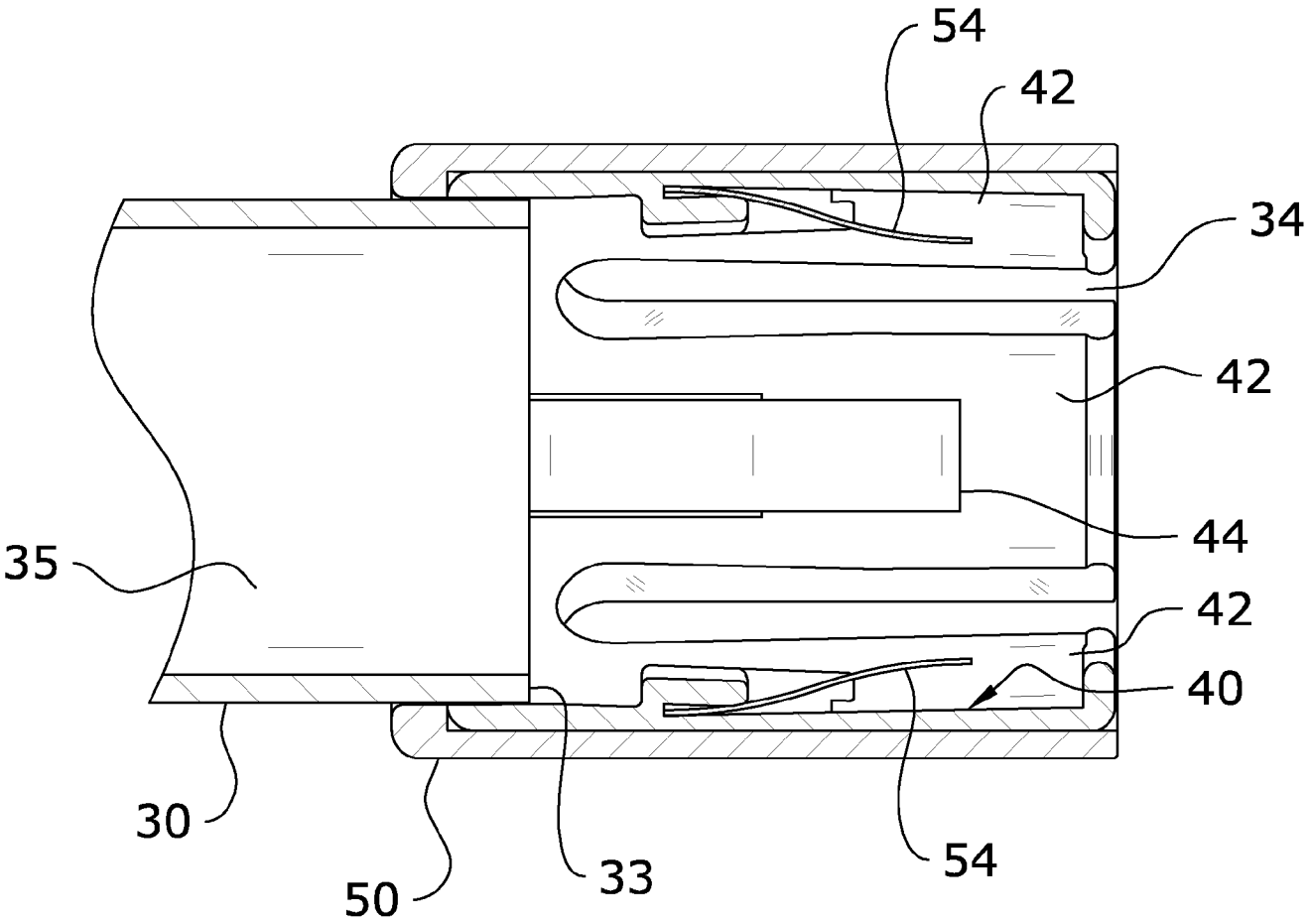
FIG. 12 is a sectional view taken along line 12-12 of FIG. 9.

Preferably, a first retaining member 44 comprised of a flexible, tapered elongated member will be secured to a first finger 42 and a second retaining member 45 similarly comprised of a flexible, tapered elongated member will be secured to a second finger 42 as shown in FIGS. 12 and 14. As best shown in FIG. 13, the retaining members 44, 45 taper toward each other so as to engage with the base 22 of the cleaning cartridge 20 so as to prevent it from being expelled along with a spent cleaning cartridge 20 when the adjustable fingers 42 are opened.

The retaining members 44, 45 will retain unspent cleaning cartridges 20 within the channel 35 when the outer sleeve 50 is pulled back. When the outer sleeve 50 is returned to position, the outermost of the retained cleaning cartridges 20 will be engaged by the fingers 42 of the nozzle 40 and be ready for use.

ii. Outer Sleeve.

As shown throughout the figures, the dispensing unit 30 includes an outer sleeve 50 which is manipulated to open and close the nozzle 40 around the outermost cleaning cartridge 20. The outer sleeve 50 is generally comprised of a collar which is slidably secured around the outlet opening 34 of the dispensing unit 30 as best shown in FIGS. 2 and 3.

The outer sleeve 50, when positioned over the nozzle 40 as shown in FIG. 1, will close the adjustable fingers 42 so that they engage with the base 22 of the outermost cleaning cartridge 20 to partially retain the outermost cleaning cartridge 20 within the outlet opening 34. When the outer sleeve 50 is slid back and retracted from the nozzle as shown in FIG. 2, the adjustable fingers 42 of the nozzle 40 will naturally expand outwards to release the spent cleaning cartridge 20 as shown in FIG. 6. When the outer sleeve 50 is returned to its rested position, such as by pushing the outer sleeve 50 manually, an advancement member 54 will engage with and push forward the next cleaning cartridge 20 and the adjustable fingers 42 will close around this new outermost cleaning cartridge 20, which will then be ready for use. In some embodiments, instead of pushing/pulling the outer sleeve 50, it may be rotated in a first and/or second direction.

The outer sleeve 50 may include a gripping member 52 along its outer surface as shown throughout the figures to aid in pulling back the outer sleeve 50 to open the nozzle 40. The outer sleeve 50 will also preferably include an advancement member 54, such as a tab as shown in the figures, which is adapted to engage with and advance the next cleaning cartridge 20 in line after expelling the spent cleaning cartridge 20. When the outer sleeve 50 is pushed back into its rested position flush with the nozzle 40, the advancement member 54 will push the cleaning cartridge 20 through the retainer members 44, 45 to partially extend through the nozzle 40.

iii. Handle.

Figure 4:
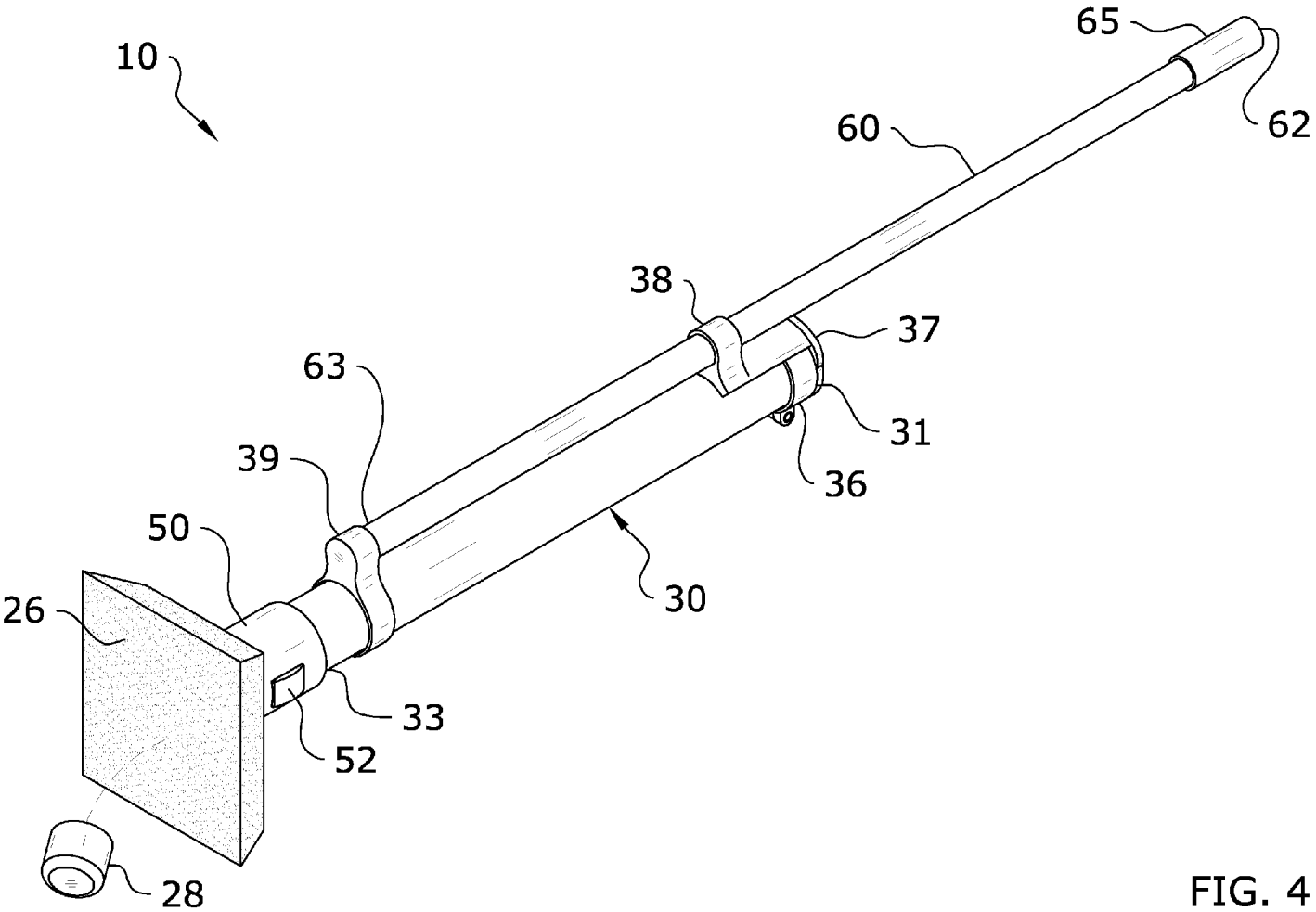
FIG. 4 is an upper perspective view of the dispenser unit with an expanded cleaning member extending therefrom.
Figure 5:
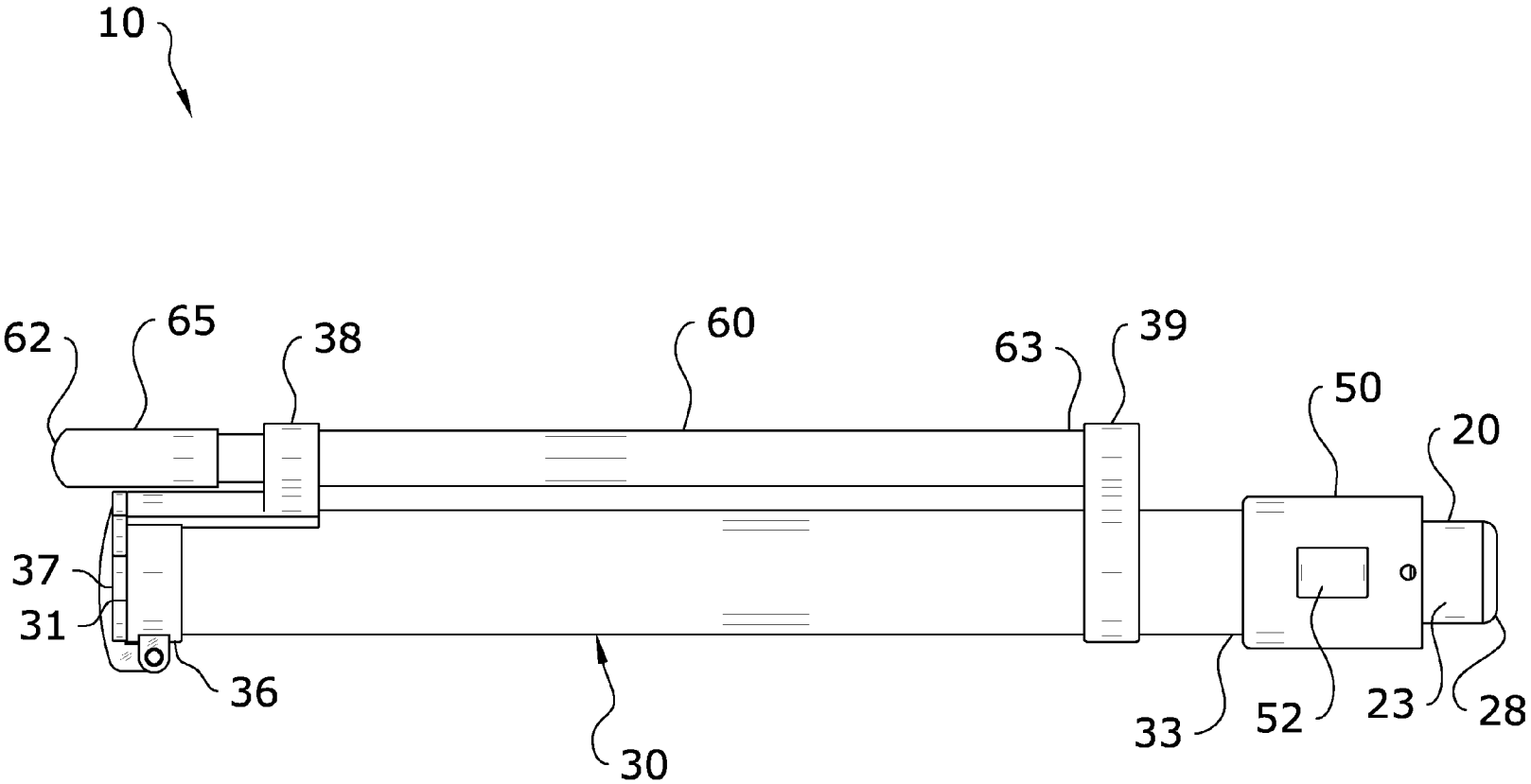
FIG. 5 is a side view of the dispenser unit of the present invention with a cleaning cartridge positioned therein.

As best shown in FIGS. 1 and 4, the dispensing unit 30 may include an attached handle 60 which may be used to extend the reach of the dispensing unit 30 so that it may act as a mop or other elongated cleaner. The handle 60 is generally secured parallel to the dispensing unit 30 via a pair of brackets 38, 39. The first end 62 of the handle 60 will preferably extend through the first bracket 38 and include a gripping portion 65 to be grasped by a user of the present invention. The second end 63 of the handle 60 will preferably be secured within the second bracket 39 of the present invention.

The handle 60 will preferably be telescoping via any of the known methods in the art for allowing an elongated member to be telescopically configured. In alternate embodiments, the handle may 60 also be comprised of a pivoting and/or fixed configuration. The scope of the present invention should not be construed as limited by the figures as it pertains to the configuration, shape, or size of the handle 60.

D. Operation of Preferred Embodiment

In use, the cleaning cartridges 20 are first inserted into the channel 35 of the dispensing unit 30 by opening the hinged cap 37 and inserted each cleaning cartridge 20 through the inlet opening 32. The outermost cleaning cartridge 20 will be partially retained within the outlet opening 34 by the adjustable fingers 42 of the nozzle 40. The hinged cap 37 may be closed when the channel 35 has been filled with the proper amount of cartridges 20.

When ready for use, the outermost cleaning cartridge 20 may be activated by removing or breaking the outer covering 28 thereof to expand and expose the cleaning member 26. The cleaning member 26, which is stored within the closed outer covering 28 in a compacted state, will expand upon removal or breaking of the outer covering 28 to be ready for use in cleaning. If desired, the handle 60 may be telescoped outward so as to use the dispensing unit 30 as a mop.

Upon completion of cleaning, the spent cleaning cartridge 20 may be expelled by pulling the outer sleeve 50, which exposes the adjustable fingers 42 of the nozzle 40 and allows them to expand outwards to expel the spend cartridge 20. The remaining cartridges 20 will be retained within the channel 35 of the dispensing unit 30 by the retaining members 44, 45 of the nozzle 40. The outer sleeve 50 may then be pushed forward again, at which time the advancement member 54 will engage with the next cleaning cartridge 20 in line and push it forward into the nozzle 40 to be partially retained therein for further use.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A cleaning mop system, comprising:

a dispenser, wherein said dispenser includes a first end and a second end;

a telescopic handle secured to an outer surface of said dispenser via one or more brackets, wherein said telescopic handle extends parallel to said dispenser;

a plurality of cleaning cartridges positioned within said dispenser, wherein said plurality of cleaning cartridges includes an outermost cleaning cartridge positioned adjacent said first end of said dispenser;

a nozzle positioned at said first end of said dispenser; and an outer sleeve slidably positioned over said nozzle, wherein said outer sleeve is operable in a first position to retain said nozzle in a closed state to secure said outermost cleaning cartridge partially within said nozzle and wherein said outer sleeve is operable in a second position to release said nozzle to dispense said outermost cleaning cartridge.

2. The cleaning mop system of claim 1, wherein said plurality of cleaning cartridges are each comprised of a container, a base, and a cleaning member stored within said container.

3. The cleaning mop system of claim 2, wherein said cleaning member is comprised of a sponge soaked in a cleaning solution.

4. The cleaning mop system of claim 2, wherein said nozzle is comprised of a plurality of adjustable fingers, said adjustable fingers being adapted to engage with said base of said outermost cleaning cartridge.

5. The cleaning mop system of claim 4, wherein an inner surface of one or more of said adjustable fingers includes a retention member for retaining said cleaning cartridges within said dispenser.

6. The cleaning mop system of claim 1, further comprising an advancement member extending inwardly from said outer sleeve for engaging with and advancing one of said plurality of cleaning cartridges.

7. The cleaning mop system of claim 1, wherein said second end of said dispenser includes a hinged cap covering an inlet opening.

8. The cleaning mop system of claim 1, wherein said telescopic handle is secured to an outer surface of said dispenser by one or more brackets.

9. A cleaning mop system, comprising:

a dispenser, wherein said dispenser includes a first end, a second end and a channel between said first end and said second end;

a telescopic handle secured to an outer surface of said dispenser by one or more brackets, wherein said telescopic handle extends parallel to said dispenser;

a plurality of cleaning cartridges positioned within said channel of said dispenser, wherein said plurality of cleaning cartridges are each comprised of a container, a base, and a cleaning member stored within said container; wherein said plurality of cleaning cartridges includes an outermost cleaning cartridge, wherein said cleaning member is retained within said cleaning cartridge in a compacted state, wherein said cleaning member is adapted to expand upon removal of said container, wherein said cleaning member is sealed within said container;

a nozzle positioned at said first end of said dispenser;

a hinged cap positioned at said second end of said dispenser;

an outer sleeve slidably positioned over said nozzle; and an advancement member extending inwardly from said outer sleeve, wherein said nozzle is comprised of a plurality of adjustable fingers, said adjustable fingers being adapted to engage with said base of said outermost cleaning cartridge, wherein said outer sleeve is operable in a first position to retain said adjustable fingers in a closed state to secure said outermost cleaning cartridge partially within said nozzle and wherein said outer sleeve is operable in a second position to release said adjustable fingers to dispense said outermost cleaning cartridges.

* * * * *